US006273276B1

(12) United States Patent
Upton et al.

(10) Patent No.: US 6,273,276 B1
(45) **Date of Patent: *Aug. 14, 2001**

(54) GRAVITY FLOW SHELVING SYSTEM

(75) Inventors: Ronald D. Upton, Spartanburg; Harry A. Brancheau, Inman, both of SC (US)

(73) Assignee: Specialty Equipment, Inc., Aurora, IL (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/283,639

(22) Filed: Apr. 1, 1999

(51) Int. Cl.[7] ..... A47F 1/04
(52) U.S. Cl. ..... 211/59.2; 211/153; 211/90.03
(58) Field of Search ..... 211/59.2, 90.01, 211/90.03, 184, 74, 41.3–41.4, 126.9, 134, 153, 181.1, 133.2, 133.5; 248/231.81, 175, 153; D6/462–466

(56) References Cited

U.S. PATENT DOCUMENTS

| | | | | |
|---|---|---|---|---|
| Re. 33,913 | | 5/1992 | Kral et al. . | |
| D. 343,075 | * | 1/1994 | Cappel, III | D6/462 |
| 1,254,287 | * | 1/1918 | Sterling | 211/41.4 |
| 2,005,939 | * | 6/1935 | Hibbard, Jr. | 211/153 |
| 2,889,054 | * | 6/1959 | Wheeler | 211/153 |
| 2,923,415 | * | 2/1960 | Brown . | |
| 3,164,108 | * | 1/1965 | Romero | 211/41.4 |
| 3,169,641 | * | 2/1965 | Chapman | 211/41.4 |
| 4,023,682 | * | 5/1977 | Niece | 211/184 |
| 4,292,902 | * | 10/1981 | Barrineau . | |
| 4,293,062 | * | 10/1981 | Bustos | 211/59.2 |
| 4,782,959 | | 11/1988 | Kral et al. . | |
| 4,890,746 | * | 1/1990 | Trulaske, Sr. | 211/59.2 |
| 4,955,486 | * | 9/1990 | Trulaske, Sr. | 211/59.2 |
| 4,958,739 | | 9/1990 | Spamer . | |
| 4,977,754 | | 12/1990 | Upton et al. . | |
| 5,022,540 | * | 6/1991 | Vail, Sr. et al. | 211/126.9 |
| 5,076,443 | * | 12/1991 | Trulaske, Jr. | 211/59.2 |
| 5,133,463 | * | 7/1992 | Merl | 211/153 |
| 5,152,230 | * | 10/1992 | Licari | 248/231.8 |
| 5,201,191 | | 4/1993 | Bustos . | |
| 5,325,973 | * | 7/1994 | Reedy | 211/90.01 |
| 5,333,746 | | 8/1994 | Bustos . | |
| 5,351,842 | * | 10/1994 | Remmers | 211/90.01 |
| 5,437,380 | * | 8/1995 | Peay et al. | 211/184 |
| 5,464,279 | | 11/1995 | Wells et al. . | |
| 5,490,600 | | 2/1996 | Bustos . | |
| 5,553,934 | | 9/1996 | Wells et al. . | |
| 5,607,068 | * | 3/1997 | Coretti, Jr. et al. | 211/59.2 |
| 5,779,069 | * | 7/1998 | Scully | 211/153 |
| 6,012,593 | * | 1/2000 | Knittel et al. | 211/41.3 |

* cited by examiner

*Primary Examiner*—Daniel P. Stodola
*Assistant Examiner*—Jennifer E. Novosad

(57) ABSTRACT

A rack for a shelf which may be mounted to an existing shelf. The rack has a series of front and rear securing clasps which maintain the rack in a tensioned fashion to the shelf. The rack provides a series of product sleeves defined by overhead rails. Stop members at the front and rear of the rails secure the rails in place and allow the rack to be reversible. The reversible nature of the rack also allows variation of the selected stop height within a single rack. The rack may be a part of a gravity feed shelf assembly.

10 Claims, 8 Drawing Sheets

GRAVITY FLOW SHELVING SYSTEM

BACKGROUND OF THE INVENTION

1. Field of Art

The present invention relates generally to container storage racks and more particularly to gravity flow shelving systems adapted for the display and storage of a variety of merchandise. The present invention features a versatile shelving system having easily adjustable and insertable racks to adapt to a variety of merchandising arrangements. The system is particularly useful for gravity feed shelving applications.

2. Prior Art

Gravity flow shelving systems are known in the merchandising art. Prior art gravity flow racks generally include an assembly of vertically spaced racks angled downwardly and forwardly, providing more shelf space than flat shelving units. During gravity flow, substantial slidable contact is made between the bottom surface of the merchandise and the upper surface of the rack. To expedite the sliding movement, each rack typically features a low friction track surface so that when a purchaser removes merchandise from the front of the rack, the remainder of the merchandise slides forward to facilitate handling by the next purchaser. This provides a natural first in first out (FIFO) movement to ensure that earlier-dated items are sold first.

Shelving systems need to be adaptable to accommodate various types of merchandise containers, product profiles, and seasonal merchandise. For instance, fresh liquids are primarily packaged in square paper-product containers coated with suitable plastics or paraffin. Other merchandise may include canned beverages, along with glass or plastic bottles and encompass a wide range of container sizes and shapes. As merchandising needs change, the prior shelving system or arrangement may be unsuitable for a new product.

Further, packaged liquids and beverages will leak when mishandled or when product integrity fails. When liquids collect on the gravity flow racks, unsightly and unsanitary bacteria-breeding conditions are created. Accumulations of such liquids also leave sticky residues that adversely affect low friction sliding surfaces and may soil fresh product beneath the gravity feed shelf. Such problems often require extensive product removal and shelf disassembly for effective cleaning of the shelves and merchandise.

One solution to these problems is set forth in U.S. Pat. No. 4,331,243, to Doll, incorporated herein by reference, where Doll discloses a gravity flow rack in which wire shelves are coated with an epoxy enamel. Triangular bent-wire divider-track members are mountable on each shelf, forming parallel merchandise channels or rows. Containers stocked in the rows are supported beneath by only two thin wire tracks, thereby requiring minimal surface contact between the bottoms of the containers and the rack surface, and thus substantially reducing the problems associated with the commercial handling of fresh liquids. However, the shelving and dividers of the Doll gravity flow rack are secured using wing nuts and bolts, making it relatively difficult to assemble or vary the configuration of the Doll gravity flow rack.

U.S. Pat. No. 5,490,600 to Bustos, incorporated herein by reference, provides a cooler gravity feed rack in which divider panels are placed onto shelves supported in a cantilevered fashion between adjacent support posts. The shelves of Bustos requires significant structural detail and additional engagement pieces to be operative as taught.

OBJECTS OF THE INVENTION

It is an object of the present invention to provide a gravity flow rack that may be easily and quickly configured and cleaned.

Another object of the invention is to provide a gravity flow rack in which the rack is made from predominantly inexpensive wire or inexpensive plastics.

A further object is to provide a gravity feed shelf in which advertising or pricing labels may be easily inserted to facilitate the merchandising of the containers.

Yet another object is to provide an insertable organizing rack which may be used with both conventional gravity feed and flat wire shelving to organize the shelf merchandise.

A still further object is to provide a organizing rack for a shelf having component parts that are easy to assemble and interchange so as to accommodate different types and sizes of containers.

Still another object is to provide a rack and shelf assembly that is relatively inexpensive to make.

A further object is to provide a rack that is easy to disassemble and clean.

Yet another object is to provide a gravity flow rack that will be compatible with existing gravity shelves.

A still further object of the invention is to provide a gravity flow rack that is attractive and decorative.

Another object of this invention is to provide a rack insert which is reversible to accommodate merchandise of varying height.

Another object is to provide shelving for a gravity flow rack that is lightweight yet durable and relatively strong.

An additional object is to provide a gravity flow rack in which the racked items automatically are maintained in the proper order and in which the front of each succeeding item automatically moves into place on the front face of the rack when a preceding item is removed from the rack.

These and other objects and advantages will become apparent as the specification proceeds.

SUMMARY OF THE INVENTION

The foregoing and other objects are achieved by the present invention of a gravity flow shelf assembly comprising: a rack having a first rail and a second rail, the first and the second rails positioned a spaced distance apart and defining a sleeve therebetween, the first rail having a front shank, a rear shank, and an inter-connecting segment, the interconnecting segment connected to the front shank along the first bend and further connected to the rear shank along a second bend; the second rail having a front shank, a rear shank, and an interconnecting segment, the inter-connecting segment connected to the front shank along the first bend and further connected to the rear shank along the second bend; a first stop member, carried by and positioned between the first front shank and the second rail front shank; a second stop carried by and positioned between the first rail rear shank and the rail rear shank; a first engaging member defined by a terminal free end of at least one of the first or the second front shank and a second engaging member defined by a terminal free end of at least one of the first or the second rear shanks; a gravity feed shelf having an outer frame, a portion of a front frame and a rear frame being respectively engaged by the first engaging member and the second engaging member of rack. Alternatively, the rack element alone may be provided and secured to existing gravity feed shelves.

BRIEF DESCRIPTION OF THE DRAWINGS

The preferred embodiment is shown in the attached drawings in which.

DESCRIPTION

In the following detailed description of the preferred embodiments, spatially orienting terms, such as "top", "front", "upper", "above", etc. are used for ease of description. It is understood that this description does not by itself limit the scope of the invention to the orientation in space as thus stated in the description.

DETAILED DESCRIPTION OF THE PREFERRED EMBODIMENTS

Figure 1:
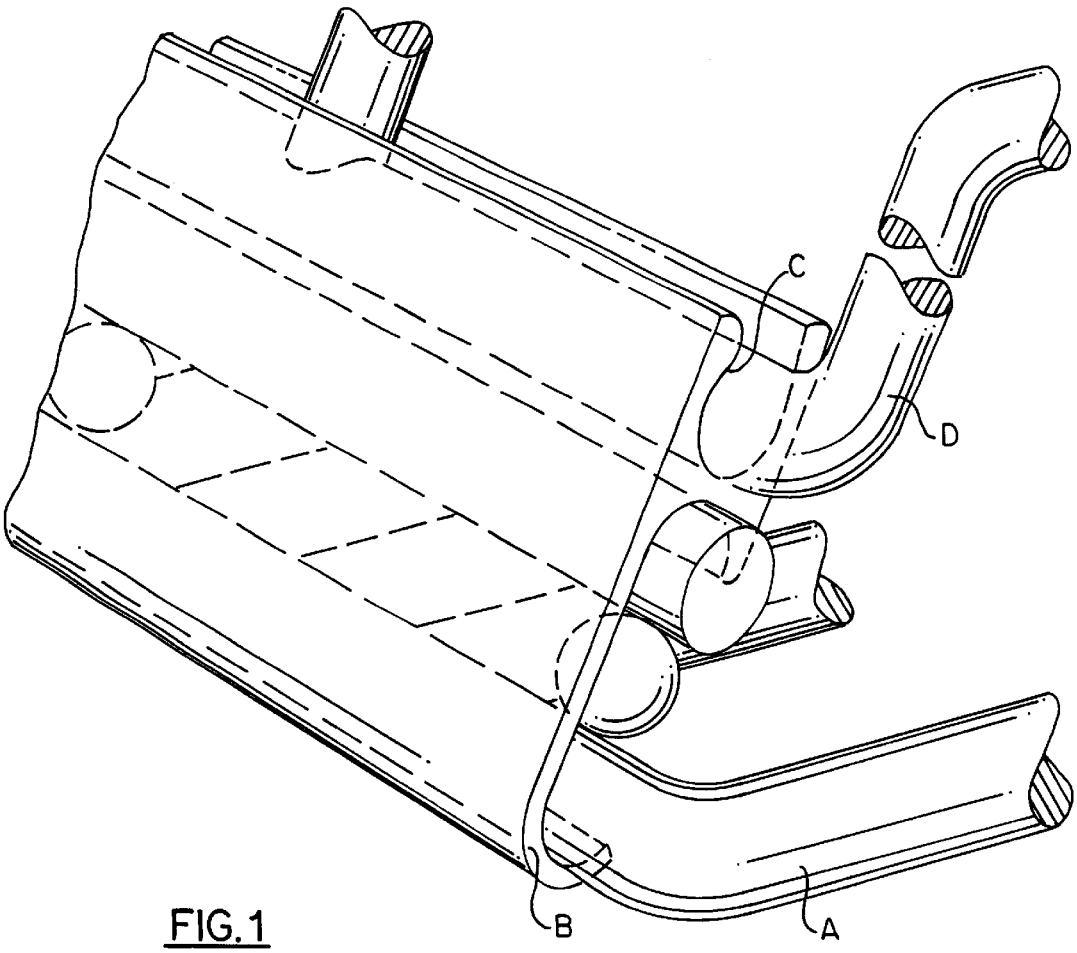
FIG. 1 Prior Art
FIG. 1 is an example of a prior art gravity shelf rack using a plastic clip to join an organizer to a lower support rack.

In FIG. 1, a prior art gravity rack is illustrated which comprises a lower shelf support rack A which may be positioned at a downward angle within a refrigerator enclosure. Support rack A may be secured within the enclosure through any of a variety of well-know securing means. A clip B is attached along two inner curved portions to respective rails of support rack A. Clip B further defines a U-shaped channel C to which an overhead organizing rack D is attached. The front surface of clip B may be used as a flavor strip to accommodate advertising and product promotional information. While clip B is functional with respect to allowing an organizing rack to be installed, the clip is time consuming to operate and inconvenient to use. Further, the clips are subject to breakage over time through temperature extremes and normal wear as the gravity feed product continually slides against the clip.

Figure 2:
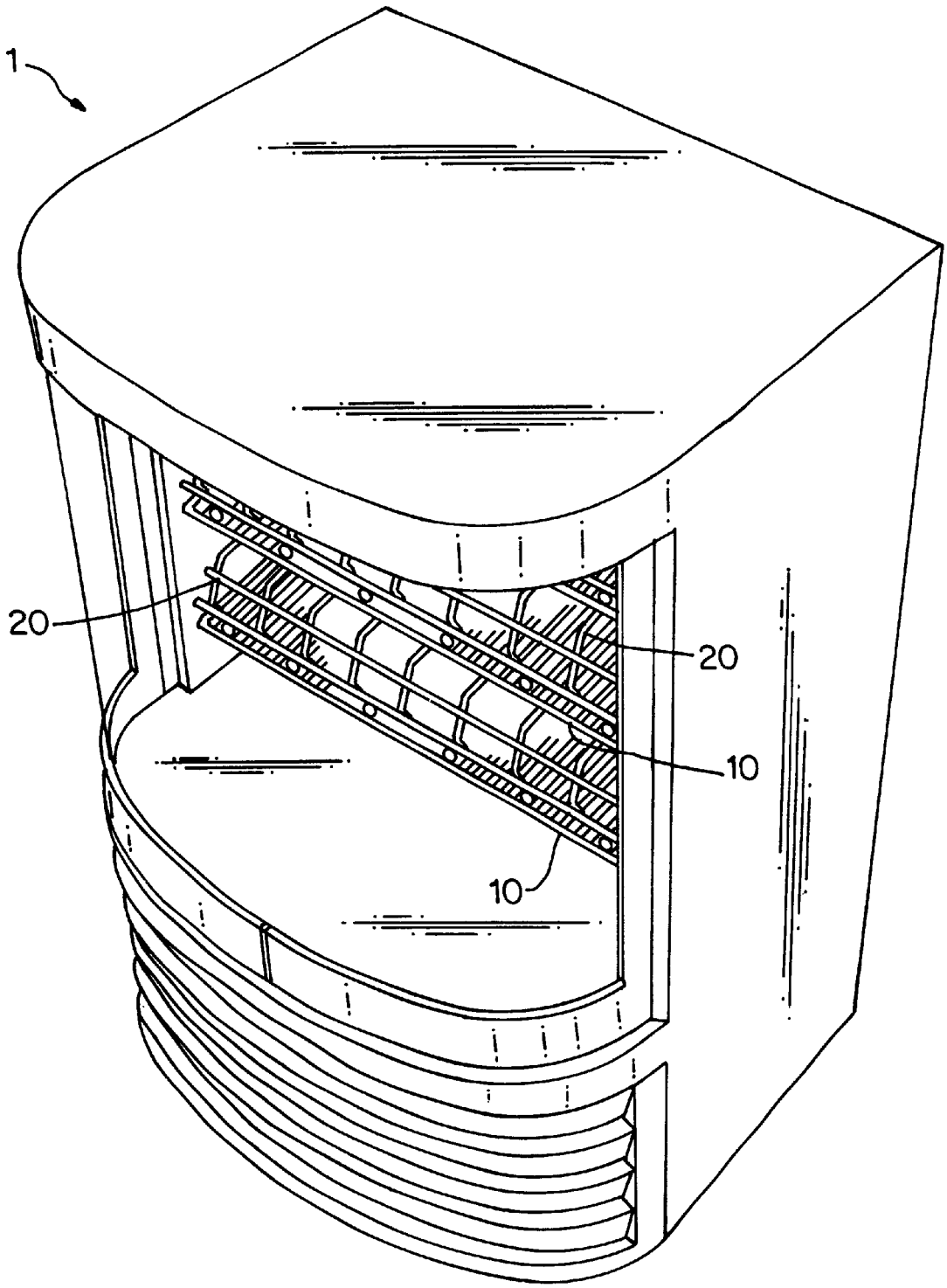
FIG. 2 is a top, front perspective view of a gravity feed shelf in which an organizing rack of the present invention is installed onto the support racks to provide merchandise dividers.
Figure 3:
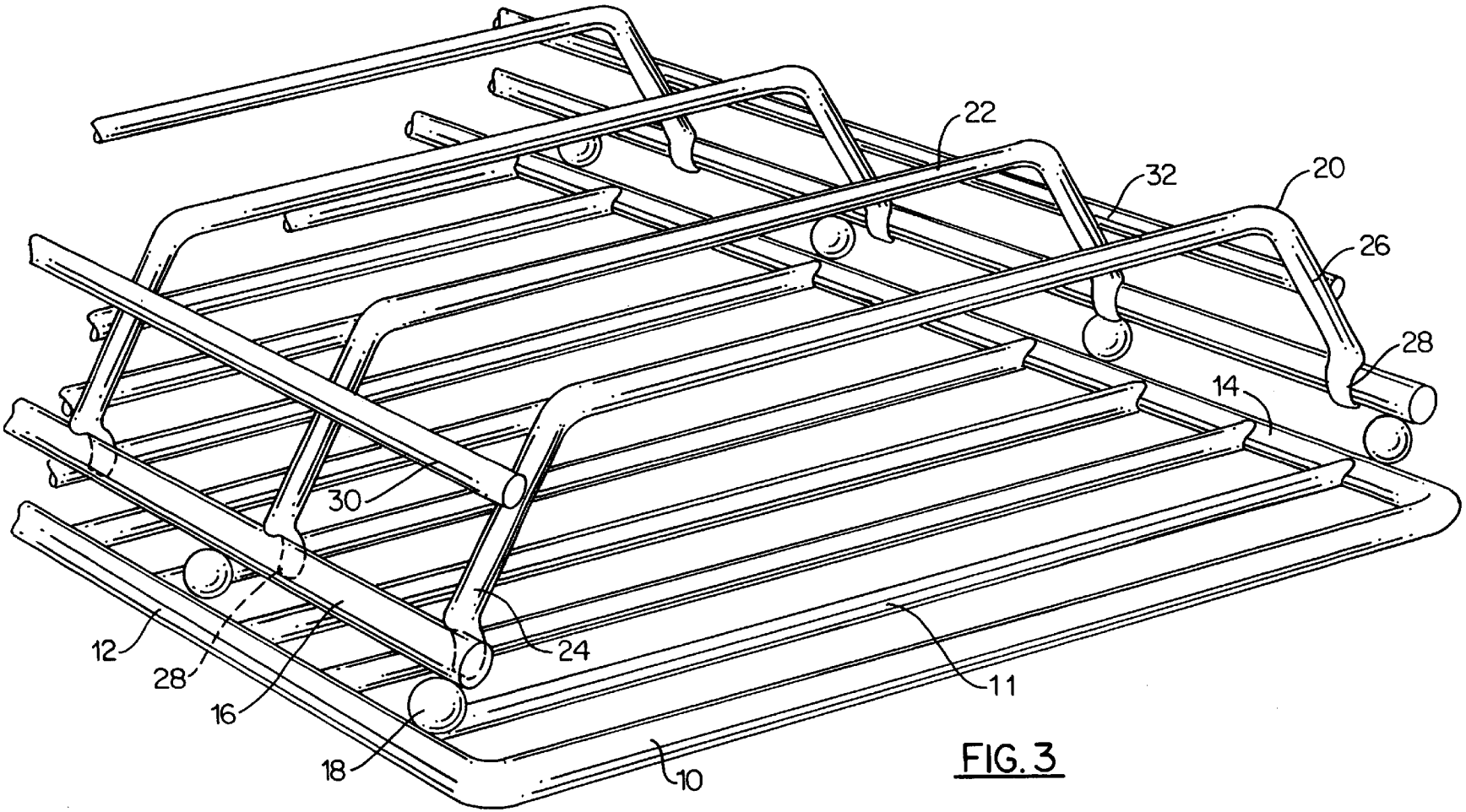
FIG. 3 is a side perspective view of a merchandise shelf carrying an organizing rack in accordance with the present invention.

The present invention provides an improved organizing rack which is designed to be inserted between the front and rear rails of an existing wire shelf. The rack is particularly useful with respect to gravity feed shelves but also offers advantages when used with conventional flat shelving. The organizing rack is held in place by the spring tension between engagement prongs of the organizing rack and the support rails of the wire shelf. As seen in FIG. 2, a refrigeration unit 1 provides a series of wire shelves 10. A removable organizing rack 20 is positioned between the front shelf rails and the rear shelf rails. As best seen in reference to FIGS. 3–5, a wire shelf 10 defines a plurality of rounded support grids 11 connecting a shelf front 12 to a shelf rear 14. The front 12 and rear 14 shelf further defines a respective reinforcing bar 16 which is welded to support posts 18 and which maintains the bar in an elevated, floating profile above the front and rear of the shelf 10.

Organizing rack 20 is provided by a plurality of guide rails 22. Each guide rail 22 has a substantially straight mid section with opposing downwardly angled shank portions 24 and 26 at respective ends of rail 22. A terminus of shank portion 24 and 26 each defines an engaging means seen in the form of an arcuate clip, prong, or clasp 28. The curvature of clasp 28 is adapted for engaging the outer circumference of support rail 16. The respective shape of clasp 28 may be varied to accommodate the size and shape of the corresponding support rail. A curved shape to the engaging member is useful in that the shape is compatible with the majority of support shelves which uses round wire construction.

Guide rails 22 are attached by a weld or other suitable mechanism to a front stop 30 and a rear stop 32 which collectively secures the guide rails in a fixed position, thereby forming a sleeve. Stops 30 and 32 engage the lower most product (see FIG. 4) secured within the sleeve as defined between adjacent guide rails. Rails 22 and shank portions 24 and 26, which are in communication with the respective terminal clasps 28, provide sufficient flexibility and movement to allow the clasps 28 to engage reinforcing bar 16 in a tensioned configuration. Such movement, indicated by directional arrows "T" in FIG. 5, allow the rack 20 to engage racks which may vary slightly in overall shelf length. Rails 22 are designed to bow slightly as the rack is flexed into position. Once installed, the rack 20 defines a plurality of product sleeves between adjacent rails 22. When required, the rack 20 can be easily disengaged from the shelve 10 for cleaning or for replacement with a similar rack having different dimensions for a different sized product.

Figure 4:
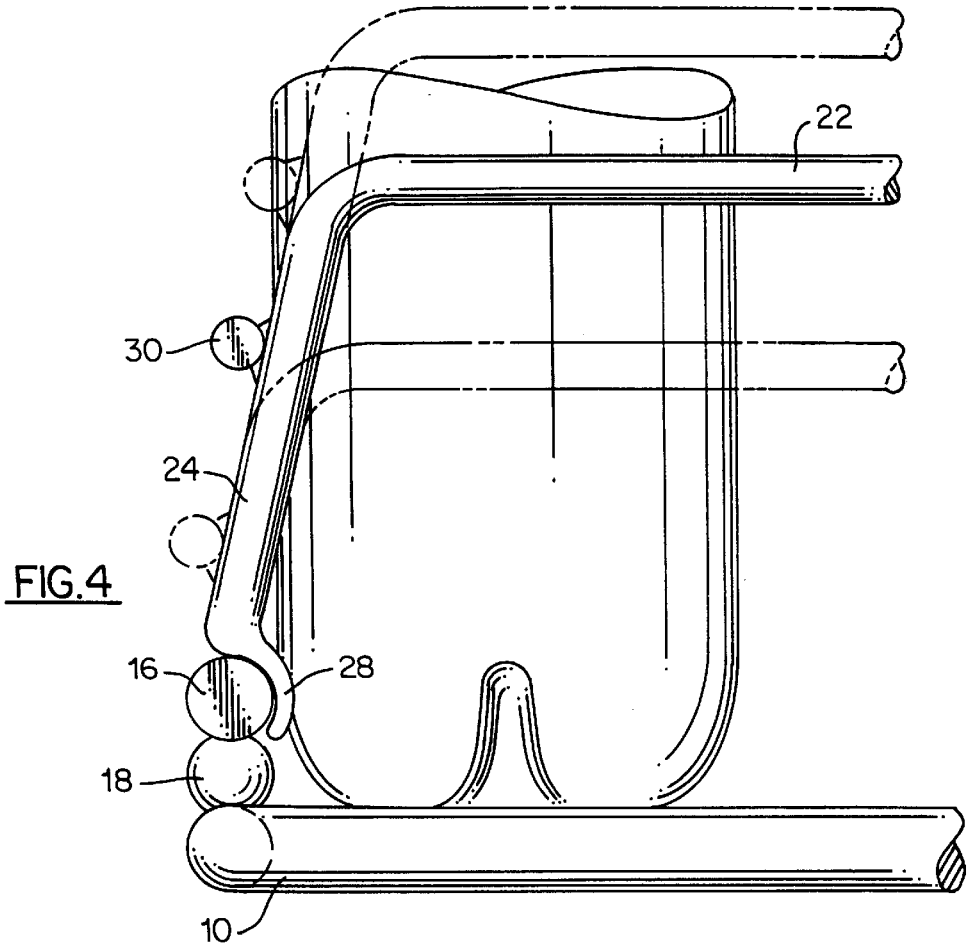
FIG. 4 is a side elevation of a organizing rack in association with a product shelf assembly.
Figure 5:
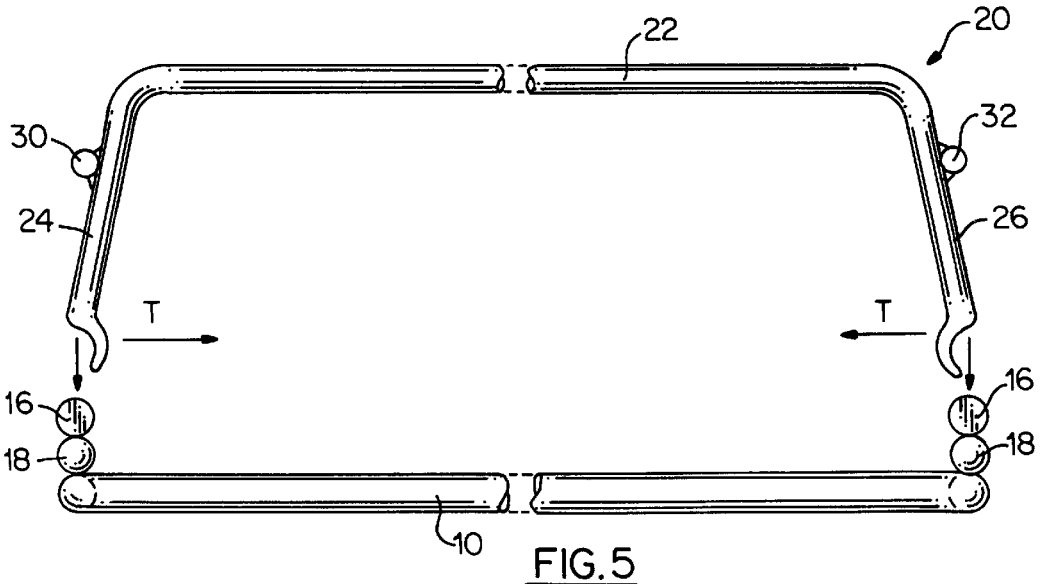
FIG. 5 is another side elevation view illustrating the attachment of the organizing rack to the lower shelf support rack.

As seen in reference to FIG. 4, the length of shanks 24 and 26 may be varied to accommodate different sized product. For instance, the lower height configuration seen in FIG. 4 could be used to dispense 16 oz bottled beverages. For taller products such as a 20 oz bottle, a longer length shank 24, seen in phantom in FIG. 4, may be used. While a preferred embodiment of the present invention secures the rack 20 to the reinforcing bar 16, rack 20 may also be secured directly to the front and rear shelf rails.

Figure 6:
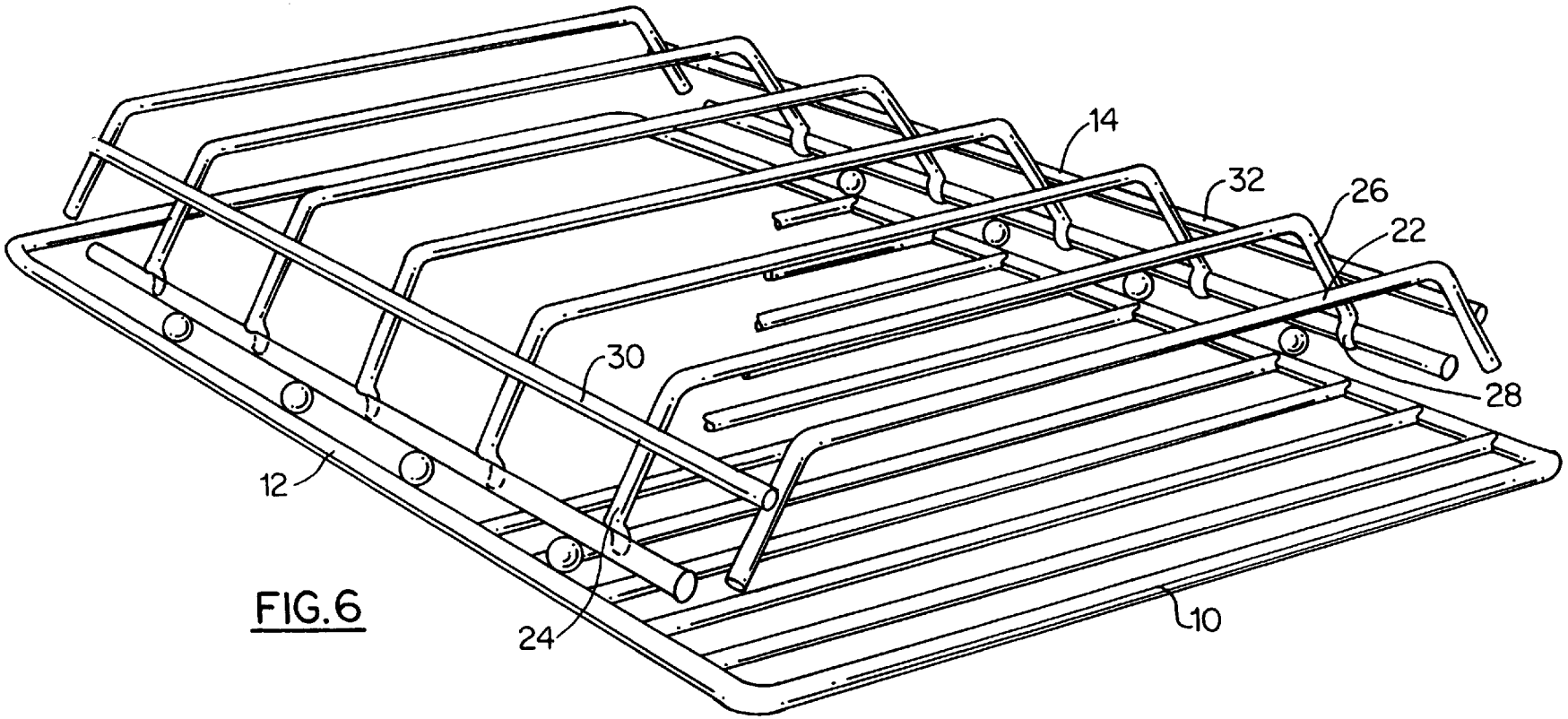
FIG. 6 is a front perspective view of the separator organizer rack mounted on the shelf.
Figure 7:
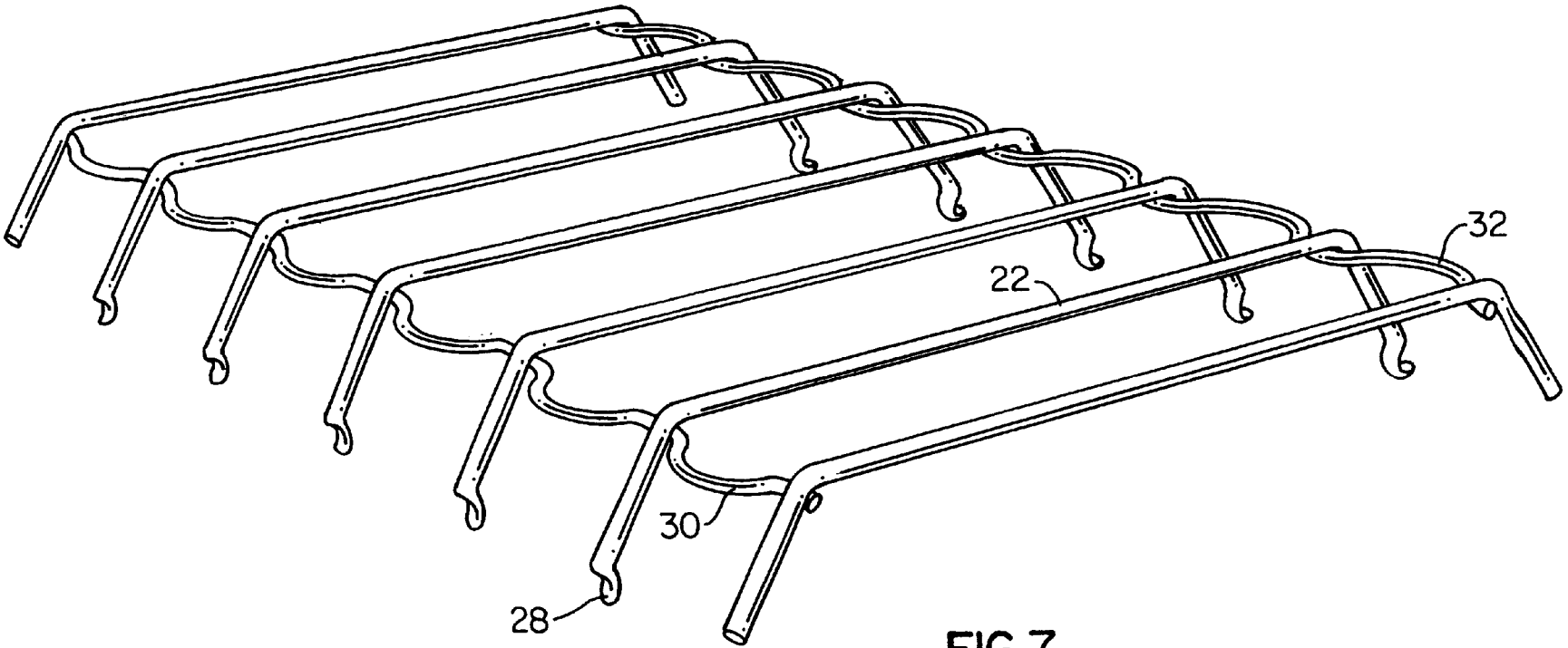
FIGS. 7–9 are front perspective views of different embodiments of organizing racks.
Figure 8:
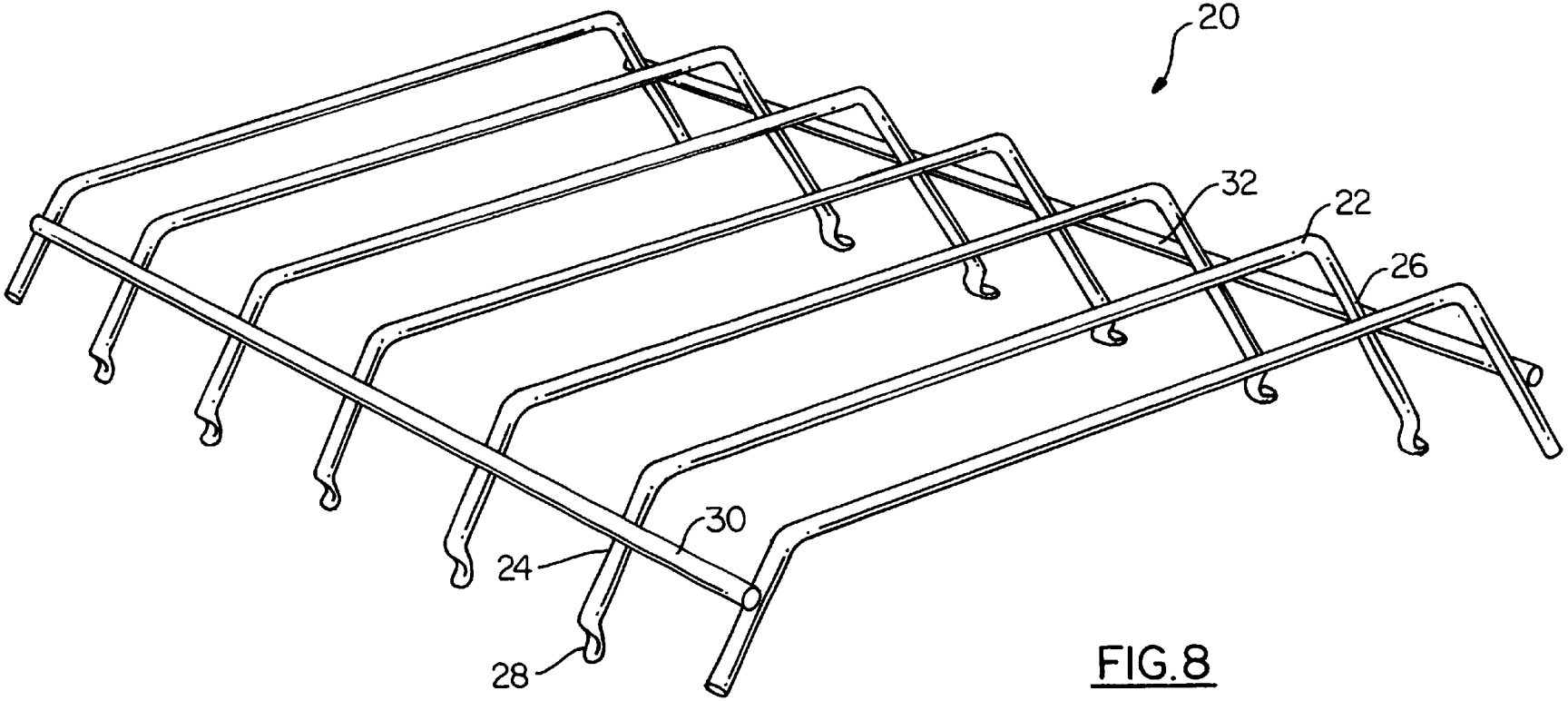
Figure 9:
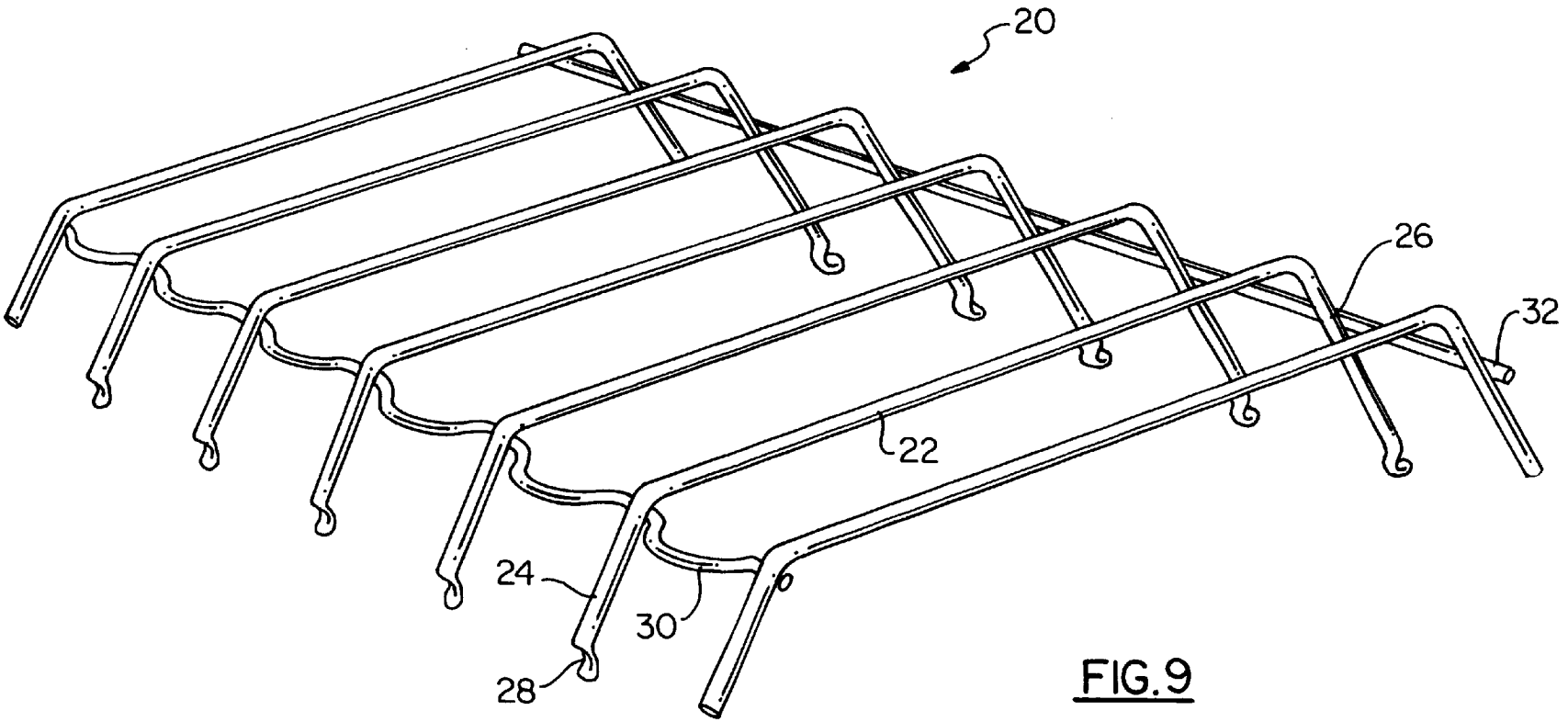

As seen in reference to the embodiments set forth in FIGS. 6 and 8, a rack 20 is set forth having substantially straight stops 30 and 32 which are useful for engaging rectangular cartons of milk, juice and similar items. The embodiments seen in FIGS. 7 and 9 employ curved stops 30 and 32, associated with an opening to each sleeve, and which are better suited for bottles and other curved container. However, while the shape of the stops preferably matches the product profile, various shaped merchandise may be used with any stop design and the shape of any particular stop is not critical to the present invention.

The relative height and width of the rack component parts may be adjusted to accommodate particular product shapes or sizes. As further seen in reference to FIG. 9, the front 12 and back 14 of rack 20 may have different lengths for shanks 24 and 26. In this manner, reversing the rack orientation can enable a different height sleeve and stop to be provided by a single, reversible rack. Further, in keeping with the present invention, a single rack may have different stop designs between the front and rear of the rack. Again, such a modification will allow a single reversible rack to accommodate different shaped products by a simple reversal of the rack.

For the simplicity of illustration, each rack illustrated above provides a series of identical sized compartments. However, a rack 20 may be provided in which the width of adjacent sleeves may vary so as to accommodate different product configurations in a single shelf. For instance, three adjacent compartments may be provided and sized appropriately to engage a respective standard size pint, quart, and half gallon container of milk or juice. Such an arrangement maintains like products in physical proximity to facilitate customer use and product restocking.

While the above embodiments illustrate a single unitary rack running the width of a shelf 10, it is within the scope of the present invention to provide two or more narrower racks within a single shelf. Such a system may be useful for shelving systems where rectangular and curved product containers need to be displayed within the same shelf 10. Accordingly, two adjacent racks may be provided, one having a straight stop useful for flat container surfaces while the adjacent rack has curved stops for round containers. Similarly, separate racks can be used in an adjacent configuration where the respective product heights are so different that a single rack of uniform size would be unable to accommodate the different products. Of course, a single rack could be constructed having different height guide rails, shanks and stops across the width of a single rack.

The present invention provides a versatile rack for both a gravity feed shelf and a flat wire shelf without need for separate fasteners. The rack design further provides for rapid, inexpensive, and secure adjustment, and readjustment of racks. In turn, this allows the shelf space and product offerings to be varied by the retailer to accommodate seasonal demand, new product designs and new product sizes. The rack can be supplied as part of an entire shelving unit or offered as a separate component for existing shelving systems.

While the embodiments illustrated and described are made in reference to rectangular gravity-feed shelves, the present invention is not limited to any particular shaped shelf. For instance, a gravity-feed shelf having a curved front can be provided with a rack of the present invention by modifying the length of the respective rails to accommodate the varying distances along the front face of the shelf. The present rack design may be provided as part of the standard shelf assembly so as to be designed and dedicated towards a particular gravity-feed shelf. However, an after-market rack can also be provided and sized accordingly to engage standard gravity rack shelves commonly used within the industry.

The rack 20 can be removed easily for cleaning the rack and associated shelving by depressing the shanks and clasps inwardly to release the rack. While not illustrated, the rack is compatible with conventional shelf liners which are used as a protective covering along the surface of shelf 10. The racks can also slide along the length of attached reinforcing bar 16 to facilitate product placement. As seen in the figures, it is not necessary to have every single shank also function as an engaging member. In a simple embodiment, a single pair of clips or clasps position upon the front and rear of the rack could suffice. However, having a larger number of engaging members increases the rigidity of the installed rack.

The metal wire used to construct the racks 20 may be made from stainless steel, powder coated steel, aluminum, or other metals which preferably have a protective finish Certain plastics could also be used to fabricate the rack 20. For metal racks, bending dies are used to create the various wire curvatures need to construct the rack. Simple welds are used to secure the stops 30 and 32 to the rails 22. Bending dies are also used to define the terminal arcuate clasp 28.

The present invention thus provides a durable gravity flow rack having easily adjustable product racks which may be constructed from relatively inexpensive materials. The rack and shelving system of the present invention allows the user to easily reposition shelf displays for different heights and at a variety of different angles. The present invention also accommodates existing merchandising channels and/or label supports to hold pricing or advertising indicia.

In the foregoing, the applicant has described the preferred embodiment of the present invention. Although desired embodiments of the invention have been described using specific terms, materials, and methods, such description is for illustrative purposes only. The words used are words of description rather than of limitation. It is to be understood that changes and variations may be made of ordinary skill in by those the art without departing from the spirit and scope of the present invention which is set forth in the following claims. In addition, it should be understood that aspects of the various embodiments may be interchanged, both in whole or in part.

What is claimed is:

1. An overhead organizing rack for a shelf comprising:

a first rail and a second rail, said first and second rails positioned a spaced distance apart and defining a sleeve therebetween, each said first rail and said second rail further defining a respective first terminal straight end and a second terminal straight end;

a first bend defined a spaced distance from the respective first end of the first and second rails;

a second bend defined a spaced distance from the respective second end of the first and second rails, the first bend and the second bend directing the respective first terminal straight ends and said respective second terminal straight ends in a direction below a plane defined by a sleeve-defining rail portion; and, a first stop member defining a series of arcuate curves, said first stop member attached to said first rail and said second rail along said first bend, a portion of said first stop member extending beyond an outer plane defined by said first ends of said first and second rails.

2. The rack according to claim 1 wherein at least one of the first straight ends of said first and second rails and at least one of said second straight ends of said first and second rails have a terminal free end defining an arcuate-shaped clasp.

3. The rack according to claim 2 wherein the rack comprises a second stop member defining an arcuate curve, said second stop member attached to said first and said second rails along said second bend.

4. The rack according to claim 2 wherein a second stop member is attached across said second ends of said first and second rails, said second stop member having a shape different from said first stop member.

5. The rack according to claim 1 wherein said spaced distance of said first bend is equal to said spaced distance of said second bend.

6. The rack according to claim 1 wherein said spaced distance of said first bend is greater than the spaced distance of the said second bend.

7. The rack according to claim 1 wherein said rack defines a second stop member defining a series of arcuate curves, said second stop member attached to said first rail and said second rail along said second bend, a portion of said second stop member extending beyond an outer plane defined by said second ends of said first and second rails.

8. The rack according to claim 1 wherein a second stop member defines a substantially straight member which extends across said second ends of said first and second rails.

9. The rack according to claim 1 wherein the rack defines a plurality of rails which define a plurality of sleeves therebetween, each one of said plurality of sleeves in communication with a first stop member, a respective portion of the first stop member extending beyond an outer plane defined by each of a front sleeve opening.

10. An overhead organizing rack for a shelf comprising:

a first rail and a second rail, said first and second rails positioned a spaced distance apart and defining a sleeve therebetween, each said first rail and said second rail further defining a respective first terminal straight end and a second terminal straight end;

a first bend defined a spaced distance from the respective first end of the first and second rails;

a second bend defined a spaced distance from the respective second end of the first and second rails, the first bend and the second bend directing the respective first terminal straight ends and said respective second terminal straight ends in a direction below a plane defined by the sleeve-defining rail portion;

a first stop member defining a series of arcuate curves, said stop member attached to said first rail and said second rail along said first bend, a portion of said stop member extending beyond an outer plane defined by said first ends of said first and second rails;

a plurality of said first straight ends and a plurality of said second straight ends each defining a terminal free end defining an arcuate-shaped clasp.

* * * * *